US005185227A

United States Patent [19]

Yamana et al.

[11] Patent Number: 5,185,227

[45] Date of Patent: Feb. 9, 1993

[54] ELECTROPHOTOGRAPHIC LITHOGRAPH PRINTING PLATE MATERIAL

[75] Inventors: Masahiro Yamana, Tokyo; Koji Sato, Kodaira, both of Japan

[73] Assignee: Oji Paper Co., Ltd., Tokyo, Japan

[21] Appl. No.: 750,371

[22] Filed: Aug. 27, 1991

[30] Foreign Application Priority Data

Aug. 28, 1990 [JP] Japan ..... 2-224290

[51] Int. Cl.[5] ..... G03G 5/09; G03G 13/26

[52] U.S. Cl. ..... 430/49; 430/92

[58] Field of Search ..... 430/49, 96, 90, 91, 430/92

[56] References Cited

U.S. PATENT DOCUMENTS 3,469,979 9/1969 Farrarini ..... 430/90

4,279,961 7/1981 Fujioka et al. ..... 430/90

4,592,977 6/1986 Naganuma et al. ..... 430/49

*Primary Examiner*—John Goodrow

*Attorney, Agent, or Firm*—Armstrong, Westerman, Hattori, McLeland & Naughton

[57] ABSTRACT

An electroghraphic lithograph printing plate material having an enhanced spectral sensitivity to semiconductor laser rays, comprises a electroconductive water-resistant support and electrophotographic layer formed on the support and comprising a photoconductive zinc oxide, a binder resin and a sensitizing dye material comprising (a) 30 to 99% by weight of a low adsorption sensitizing dye for which the zinc oxide exhibits a low adsorption rate of less than 90% and (b) 1 to 70% by weight of a high adsorption sensitizing dye for which the zinc oxide exhibits a high adsorption rate for 90% or more, the adsorption rate being measured by spectrophotometry.

10 Claims, No Drawings

ELECTROPHOTOGRAPHIC LITHOGRAPH PRINTING PLATE MATERIAL

BACKGROUND OF THE INVENTION

1) Field of the Invention

The present invention relates to an electrophotographic lithograph printing plate material.

More particularly, the present invention relates to an electrophotographic lithograph printing plate material having an enhanced sensitivity to semiconductor laser rays.

2) Description of the Related Arts

Generally, a conventional electrophotographic lithograph printing plate material has a photosensitive electrophotographic layer wherein electroconductive zinc oxide particles are dispersed as a photoconductive material. This type of lithograph printing plate material (known as a zinc oxide offset master material) is widely employed in the light printing industry, because it is cheap, and because the process for making a printing plate from the material is simple and easy.

In a conventional process for producing a lithograph printing plate from the above-mentioned printing plate material, a visible light-irradiation source, for example, a halogen lamp, is used. In this process, the visible light is irradiated to and reflected on an original image or picture and the reflected rays are irradiated to the photosensitive surface of the printing plate material. This method is referred to as a camera system printing plate-making method.

Due to the recent development of various recording machines and the spread of data digitalization a computer-to-plate type printing plate-making method is now widely used for the electrophotographic material. In this method, laser rays which can be controlled in accordance with computer data are applied to the photosensitive printing plate material surface as a scanning exposure.

Among the laser rays, semiconductor laser rays, which can be generated in a small size device and can be directly modulated, are most useful.

The zinc oxide offset master usable for the semiconductor laser rays is made from a lithograph printing plate material having a photosensitive electrophotographic layer spectrosensitized by a sensitizing dye and having an enhanced sensitivity at a wave length of 700 to 1000 nm, particularly 780 nm, of the semiconductor laser rays.

The sensitizing dye usable for the above-mentioned use is selected from polymethine type cyanine dyes. These polymethine type cyanine dyes are classified into two groups in accordance with the degree of capability thereof of being adsorbed by zinc oxide particles, i.e., low adsorption dyes which are adsorbed by the zinc oxide particles at a low adsorption rate, and high adsorption dyes which are adsorbed by the zinc oxide particles at a high adsorption rate.

The first group of low adsorption dyes, which will be referred to as low adsorption sensitizing dyes hereafter, includes the compounds, for example, of the formulae (I) and (II):

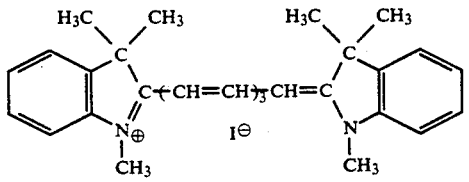

(I)

and

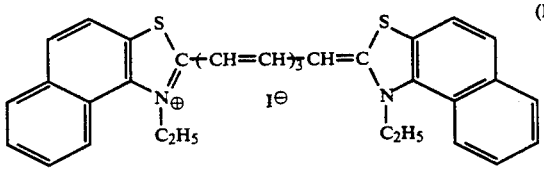

(II)

most of which compounds have alkyl or alkylether radicals attached to the N atoms.

The second group of high adsorption dyes, which will be referred to as high adsorption sensitizing dyes hereafter, include the compounds, for example, of the formulae (III) and (IV):

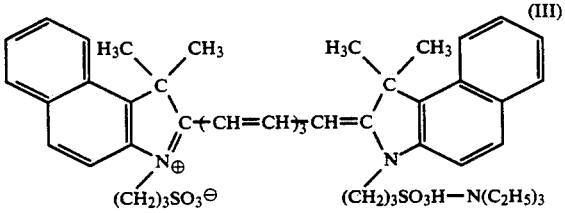

(III)

and

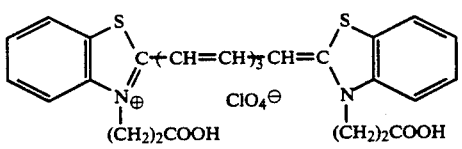

(IV)

most of which compounds have acid radicals, for example, alkylsulfonic or alkylcarboxylic acid radicals, attached to the N atoms.

These two groups of sensitizing dyes have mutually inconsistent properties. Namely, the high adsorption sensitizing dyes are advantageous in that the resultant lithograph printing plate material exhibits an excellent heat resistance, but are disadvantageous in that the dark decay of the resultant lithograph printing plate material is undesirably increased. In comparison, the low adsorption sensitizing dyes are advantageous in that the resultant lithograph printing plate material exhibits a low dark decay, but are disadvantageous in that the heat-resistance of the resultant lithograph printing plate material is poor.

The term "heat-resistance" as used herein refers to a property such that, even when exposed to an action of heat, the photosensitivity of the lithograph printing plate material is not affected. The higher the heat resistance, the higher the durability in use and during storage and transportation. Therefore, the heat resistance is a very important property of the lithograph printing plate material.

When the dark decay is high, the potential of the surface of the printing plate material is lowered during the period between the charging step and the developing step, and thus the color density (darkness) of the resultant images on the printing plate material surface is reduced.

Many attempts have been made to simultaneously obtain both a high heat resistance and a small dark decay, but these attempts were not always successful in obtaining an electrophotographic lithograph printing plate material having both an enhanced heat resistance and a reduced dark decay.

SUMMARY OF THE INVENTION

An object of the present invention is to provide an electrophotographic lithograph printing plate material having a high sensitivity to semiconductor laser rays, an excellent heat resistance, and a small dark decay.

The above-mentioned object can be attained by the electrophotographic lithograph printing plate material of the present invention, comprising (A) an electroconductive and water-resistant support, and (B) an electrophotographic layer formed on a surface of the support and comprising at least finely divided photoconductive zinc oxide, a binder resin and a sensitizing dye material comprising:

(a) 30 to 99% by weight of at least one sensitizing dye capable of being absorbed by the zinc oxide at an adsorption rate of less than 90%, and (b) 1 to 70% by weight of at least one another sensitizing dye capable of being adsorbed by the zinc oxide at an adsorption rate of 90% or more, said adsorption rate being determined in such a manner that an original dye solution having a total weight of 50 g and a concentration of methyl alcohol of 15% by weight is prepared from a sensitizing dye in an absolute weight of 1 mg and a mixed solvent consisting of toluene and methyl alcohol, 2 g of finely divided zinc oxide are dispersed in the dye solution, the resultant dispersion is stirred and then left to stand at a temperature of 25° C. for one hour, to allow the resultant dye-adsorbed zinc oxide to be precipitated and provide a clear supernatant dye solution, the original dye solution and a spectral absorption of the resultant clear supernatant dye solution is measured at a wave length at which the dye exhibits a highest absorption, and the adsorption of the sensitizing dye by the finely divided zinc oxide is calculated in accordance with the equation:

$$\text{Adsorption rate (\%)} = \frac{A - B}{A} \times 100$$

wherein A represents a maximum spectral absorption of the original dye solution at the above-mentioned wave length and B represents a maximum spectral absorption of the supernatant dye solution at the same wave length as mentioned above.

DESCRIPTION OF THE PREFERRED EMBODIMENTS

In the electrophotographic lithograph printing plate material of the present invention, the electrophotographic layer comprising a finely divided photoconductive zinc oxide and a binder resin must further comprise a mixture of at least one sensitizing dye (a) capable of being adsorbed by the zinc oxide at a low adsorption rate of less than 90% with at least one another sensitizing dye (b) capable of being adsorbed by the zinc oxide at a high adsorption rate of 90% or more.

When the low adsorption sensitizing dye (a) is used together with the high adsorption sensitizing dye (b), the resultant electrophotographic layer exhibits a dark decay substantially corresponding to an arithmetical average of the dark decay derived from the low adsorption sensitizing dye (a) and that derived from the high adsorption sensitizing dye (b), as expected.

Nevertheless, surprisingly, the electrophotographic layer containing both the low and high adsorption sensitizing dyes (a) and (b) exhibits substantially the same heat resistance as such a layer containing only the high adsorption sensitizing dye (b).

Accordingly, when the sensitizing dye material consists of a relatively large amount of the low adsorption sensitizing dye (a) and a relatively small amount of the high adsorption sensitizing dye (b), the resultant electrophotographic layer exhibits a high heat resistance similar to that containing only the high adsorption sensitizing dye (b) and a small dark decay similar to that containing only the low adsorption sensitizing dye (a).

When the content of the low adsorption sensitizing dye (a) in the sensitizing dye material is less than 30% by weight, the resultant electrophotographic layer exhibits an undesirably large dark decay. Also, when the content of the low adsorption sensitizing dye (a) is more than 99%, the resultant electrophotographic layer exhibits an unsatisfactorily low heat resistance due to a small content of the high adsorption sensitizing dye (b).

The above-mentioned unexpected effect on the heat resistance of the electrophotographic layer is derived from the following mechanism.

In an electrophotographic layer containing only the low adsorption sensitizing dye (a), the sensitivity is reduced with a rise in the temperature. This phenomenon is derived mainly from a desorption of the low adsorption sensitizing dye (a) from the finely divided zinc oxide, rather than from the decomposition of the low adsorption sensitizing dye (a). This is confirmed in that, when the sensitivity of the electrophotographic layer is reduced by heating, the spectral absorption of the dye (a) in the electrophotographic layer is substantially not reduced.

When the high adsorption sensitizing dye (b) is contained together with the low adsorption sensitizing dye (a), in the electrophotographic layer, the high adsorption sensitizing dye (b) serves as an adsorption-promoting agent for the low adsorption sensitizing dye (a), and thus prevents the desorption of the low adsorption sensitizing dye (a) from the finely divided zinc oxide.

The adsorption of the sensitizing dyes (a) and (b) is measured in the following manner.

A sensitizing dye in an absolute weight of 1 mg is dissolved in methyl alcohol and the resultant dye solution is dissolved in a mixed solvent consisting of toluene and methyl alcohol, to provide as original dye solution in a total amount of 50 g and containing methyl alcohol in a concentration of 15% by weight.

A finely divided zinc oxide in an amount of 2 g is dispersed in the original dye solution, and the resultant dispersion is stirred to allow the dye to be adsorbed by the finely divided zinc oxide, and is left to stand at a temperature of 25° C. for one hour to allow the dye adsorbed zinc oxide to be precipitated to thereby provide a clear supernatant dye solution. When the precipitation of the dye-adsorbed zinc oxide is not sufficient, the dispersion may be centrifugated.

The spectral absorption of the original dye solution and the supernatant dye solution is measured at a wave length at which the dye exhibits a highest absorption.

The adsorption rate in % of the dye by the finely divided zinc oxide is calculated in accordance with the equation:

$$\text{Adsorption rate (\%)} = \frac{A - B}{A} \times 100$$

wherein A represents a maximum spectral absorption of the original dye solution at the above-mentioned wave length, and B represents a maximum spectral absorption of the supernatant dye solution at the same wave length as mentioned above.

The low adsorption sensitizing dyes (a) usable for the present invention include the above-mentioned compounds of the formulae (I) and (II) and the compounds of the formula (V) to (VII):

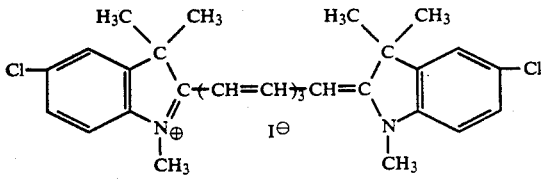

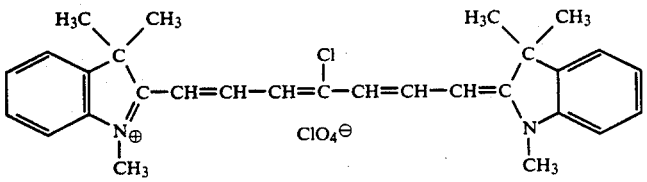

(VI)

and

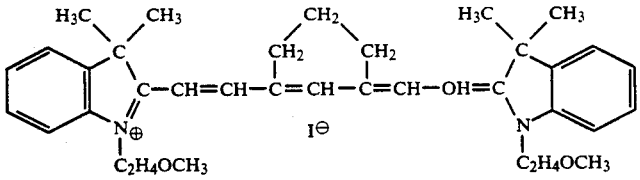

(VII)

The low adsorption sensitizing dyes (b) are not limited to the above-mentioned compounds, and any such dyes can be used as long as they are adsorbed by the finely divided zinc oxide at an adsorption rate of less than 90%.

The high adsorption sensitizing dyes (b) usable for the present invention include the above-mentioned compounds of the formulae (III) and (IV) and the compounds of the formulae (VIII) to (X):

(VIII)

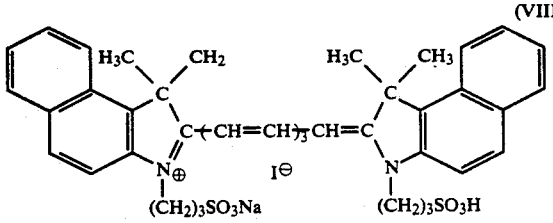

-continued (IX)

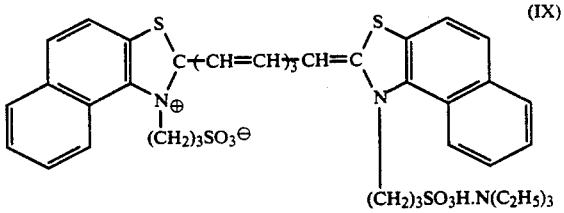

and (X)

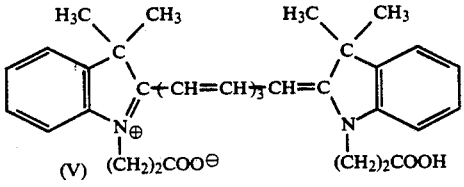

(V)

The high adsorption sensitizing dyes (b) are not restricted to the compounds as mentioned above, and any such dyes can be used as long as they are adsorbed by the finely divided zinc oxide at an adsorption rate of 90% or more.

Preferably, the low adsorption sensitizing dye is contained in an amount of 0.01 to 0.1%, more preferably 0.02 to 0.05%, based on the total solid weight of the electrophotoconductive layer. If the content is less than 0.01%, the resultant electrophotographic layer exhibits an unsatisfactory sensitivity. Also, if the content is more than 0.1%, the resultant electrophotographic layer exhibits a undesirably reduced exposure latitude.

Preferably, the high adsorption sensitizing dye is contained in an amount of 0.001 to 0.03%, more preferably 0.002 to 0.02%, based on the total solid weight of the electrophotographic layer. If the content is less than 0.001%, the resultant electrophotographic layer exhibits an unsatisfactory sensitivity. Also, if the content is more than 0.03%, the resultant electrophotographic layer exhibits a reduced exposure latitude and an enlarged dark decay.

In the electrophotographic layer of the present invention, the mixture of the low and high adsorption sensitizing dyes (a) and (b) is effective for the spectral sensitization of the photoconductive zinc oxide.

The electrophotographic layer optionally contains a chemical sensitizing agent for further sensitizing the photoconductive zinc oxide. The chemical sensitizing agent preferably comprises at least one cyclic acid anhydride selected from, for example, phthalic anhydride, maleic anhydride, dichloromaleic anhydride, pyromellitic anhydride and trimellitic anhydride.

The finely divided zinc oxide usable for the electrophotographic layer of the present invention must have a photoconductive property, and preferably, is in the form of fine particles having a size of 0.1 to 0.5 μm.

The binder resin usable for the electrophotographic layer comprises a single resinous material or a mixture of two or more resinous materials. There is no specific limitation of the type of resinous materials, as long as such resinous materials have a film-forming property sufficient for bonding the finely divided zinc oxide and other components therewith, and do not affect the photoconductivity of the zinc oxide.

The binder resin preferably comprises an oil-soluble acrylic resin. The oil-soluble acrylic resin is selected from, for example, those available under the trademark of LR-188, from Mitsubishi Rayon Co, and of Acrydic A-405 from Dainihon Ink Chemical Industry Co.

Preferably, the binder resin is contained in a solid content of 10 to 30%, more preferably 12 to 25%, based on the weight of the photoconductive zinc oxide, in the electrophotographic layer.

In the preparation of a coating liquid for forming the electrophotographic layer, the necessary components are dissolved or dispersed in a solvent comprising, for example, toluene, 2-butanon and butyl acetate. The most preferable solvent is toluene, due to its appropriate vaporizing rate and relatively small odor.

The support usable for the present invention must have a satisfactory electroconductivity and water resistance. The support is formed from a member selected from electroconductive, water-resistant paper sheets, composite sheets each comprising a core paper sheet and at least one aluminum foil or electroconductive polymeric sheets laminated on the core paper sheet, and metallized paper sheets prepared, for example, by a metal vapor deposition method.

Preferably, the support has a thickness of 100 to 170 μm, and the lithograph printing plate material has a total thickness of 130 to 200 μm.

To enhance the water-resistance of the lithograph printing plate material of the present invention, a water-resistant intermediate layer is optionally arranged between the support and the electrophotographic layer.

The water-resistant intermediate layer is prepared preferably from an intermolecularly cross-linked resinous material selected from, for example, cross-linking reaction products of water-soluble polymeric materials, for example, polyvinyl alcohol resins, casein or starch, or synthetic resin emulsions, for example, emulsions of acrylic ester copolymers, or SBR, with a cross-linking agent, for example, melamine-formaldehyde resins, glyoxal and silane-coupling agents. Usually, the intermediate layer has a dry weight of 5 to 15 g/m$^2$.

In the production of the electrophotographic lithograph printing plate material of the present invention, an electroconductive zinc oxide powder, a laser ray-sensitizing dye material, visible ray-sensitizing dye, sensitizing assistant, and a binder resin, each in a predetermined amount, are mixed with a solvent consisting of, for example, toluene, and the mixture is finely dispersed by using a mix-dispersing machine, for example, ball mill, sand grinder or paint shaker, to provide a coating liquid for forming the electrophotographic layer.

The coating liquid is applied directly to a surface of a support or to an intermediate layer surface formed on the support. The coating liquid layer is dried to form an electrophotographic layer.

The thickness of the electrophotographic layer is contributive to the electrophotographic property thereof, and thus preferably is in the range of from 5 to 25 μm, more preferably from 10 to 20 μm.

The lithographic printing plate can be produced from the electrophotographic lithograph printing plate material by subjecting the electrophotographic layer to an imagewise scanning exposure to semiconductor laser rays in accordance with digital data, to provide electrostatic latent images thereon, developing the latent images by using a liquid developing agent, and heat-fixing the resultant visible images on the printing plate surface.

When the resultant printing plate is used for an offset printing procedure, the electrophotographic layer surface having the images is treated with a conversion liquid containing, for example, sodium ferrocyanide, to make the non-image portions of the surface hydrophilic.

The treated printing plate is fixed to an offset printing machine and used for printing.

EXAMPLES

The specific examples presented below will more fully elaborate on the ways in which the present invention can be practically used. It should be understood, however, that the examples are only illustrative and in no way limit the scope of the present invention.

In the examples, the part and % are by weight unless otherwise indicated.

Also, in the examples, the compounds of the formulae (I) and (V) were employed as the low adsorption sensitizing dyes, and the compounds of the formulae (III) and (X) were used as the high adsorption sensitizing dyes.

These sensitizing dyes had the adsorption rate by zinc oxide as indicated in Table 1.

TABLE 1

| Sensitizing dye | Adsorption by zinc oxide (%) |
|---|---|
| Formula (I) | 35 |
| Formula (V) | 86 |
| Formulat (III) | 96 |
| Formula (X) | 100 |

EXAMPLE 1

A coating liquid was prepared by mixing the following components, in the order as indicated below, in a rotation mixer.

| Component | Trademark | Part by weight |
|---|---|---|
| Toluene | — | 80 |
| Methylalcohol | | 3 |
| Acrylic resin | LR-188 (40% conc.) (Mitsubishi Rayon Co.) | 45 |
| Zinc oxide | Zinc oxide EF (Hakusui Kagaku Kogyo K.K.) | 82 |
| Low adsorption sensitizing dye | Compound of formula (I) | 0.02 |

-continued

| Component | Trademark | Part by weight |
|---|---|---|
| High adsorption sensitizing dye | Compound of formula (III) | 0.01 |
| Chemical sensitizing dye | Pyromellic anhydride | 0.02 |

The sensitizing dyes were used in the form of a solution in methyl alcohol.

The mixture was dispersed by a sand grinder to provide a coating liquid.

A support composed of a composite sheet made by laminating an electroconductive-treated paper sheet having a basis weight of 80 g/m$^2$ with an aluminum foil having a thickness of 10 μm was used.

The coating liquid was applied to the aluminum foil surface of the support sheet and dried to form an electrophotographic layer having a basis weight of g/m$^2$.

An electrophotographic lithograph printing plate material was obtained.

The printing plate material was subjected to tests of the heat-resistance and dark decay thereof.

The heat resistance test was carried out as follows.

The electrophotographic lithograph printing plate material was hermetically sealed in a polyethylene bag, and heat-treated at a temperature of 60° C. for 3 days in a dryer.

The printing plate material was removed from the polyethylene bag and left to stand in the dark at room temperature for one day. Then the spectral sensitivity of the printing plate material was measured at a wave length of 780 nm, by using a sensitivity tester made by Synthia Co.

The measured sensitivity value was converted to a half value of exposure E ½ in erg/cm$^2$.

A determination of a half value of exposure E ½ of the original printing plate material, which was not heat-treated, was made.

A ratio in half value of exposure E ½ of the heat-treated printing plate material to the original (non heat-treated) printing plate material was calculated.

The calculated value ratio is referred to as an increase (%) in half value of exposure, and the larger the increase in half value of exposure, the lower the heat resistance.

The dark decay was measured in the following manner.

The surface of the printing plate material was charged at a potential of −5 kV by using a EPA device. The resistance to dark decay was represented by a ratio in % of the potential value of the printing plate material surface 60 seconds after the charging to the initial potential value thereof.

The larger the ratio, the smaller the dark decay.

The test results are shown in Table 2.

Separately, a printing plate with a predetermined pattern of images was prepared from the above-mentioned printing plate material, by employing a laser plate maker made by a Toppan Insatsu K. K.

The resultant printing plate had clear images, and after treating with a customary conversion liquid, the printing plate was used for an offset printing. The resultant prints had a satisfactory quality.

EXAMPLE 2

The same procedures as in Example 1 were carried out except that the compound of the formula (I) was replaced by the compound of the formula (V), to provide an electrophotographic lithograph printing plate material.

The resultant heat resistance and dark decay test results are shown in Table 2.

The electrophotographic lithograph printing plate material was converted to a printing plate and used for an offset printing in the same manner as in Example 1.

The images on the printing plate were clear and the resultant prints were satisfactory.

EXAMPLE 3

The same procedures as in Example 1 were carried out except that the compound of the formula (III) was replaced by 0.002 parts by weight of a compound of the formula (X) and the chemical sensitizing agent consisting of pyromellitic anhydride was omitted, to provide an electrophotographic lithograph printing plate material.

The resultant heat resistance and dark decay test results are shown in Table 2.

When the printing plate material was converted to an offset printing plate and used for an offset printing in the same manner as in Example 1, the images on the printing plate were clear and the resultant prints were satisfactory.

COMPARATIVE EXAMPLE 1

The same procedures as in Example 1 were carried out except that the compound of the formula (I) was employed in an amount of 0.03 parts by weight and the compound of the formula (III) was omitted, to provide a comparative electrophotographic lithograph printing plate material.

The resultant heat resistance and dark decay test results are shown in Table 2.

The conductive electrophotographic lithograph printing plate material exhibited a smaller dark decay and a poorer heat resistance than those of Example 1.

COMPARATIVE EXAMPLE 2

The same procedures as those in Example 2 were carried out except that the compound of the formula (V) was used in an amount of 0.03 parts by weight, and the compound of the formula (III) was omitted, to provide a comparative electrophotographic lithograph printing plate material.

The resultant heat resistance and dark decay test results are shown in Table 2.

In view of Table 2, the comparative electrophotographic lithograph printing plate material had a smaller dark decay and a poorer heat resistance than those of Example 2.

COMPARATIVE EXAMPLE 3

The same procedures as in Example 1 were carried out except that the compound of the formula (I) was omitted and the compound of the formula (III) was employed in an amount of 0.03 parts by weight, to produce a comparative electrophotographic lithograph printing plate material.

The resultant heat resistance and dark decay test results are shown in Table 2.

The comparative printing plate material had a larger dark decay than and the same heat resistance as those of Example 1.

COMPARATIVE EXAMPLE 4

The same procedure as in Example 3 were carried out except that the compound of the formula (I) was omitted, the compound of the formula (X) was employed in an amount of 0.005 parts by weight, and the chemical sensitizing agent consisting of pyromellitic anhydride was omitted, to produce a comparative electrophotoprinting lithograph printing plate material.

The resultant heat resistance and dark decay test results are shown in Table 2.

This comparative printing plate material exhibited a larger dark decay and a higher heat resistance than those of Example 3.

TABLE 2

| Item Example No. | Dark decay ratio (%) | Increase in half value of exposure (%) |
|---|---|---|
| Example | | |
| 1 | 75 | 1.12 |
| 2 | 72 | 1.10 |
| 3 | 84 | 1.05 |
| Comparative Example | | |
| 1 | 87 | 1.67 |
| 2 | 82 | 1.43 |
| 3 | 43 | 1.02 |
| 4 | 37 | 0.98 |

In view of Table 1, it is clear that the electrophotographic layers of the present invention containing both the low and high adsorption sensitizing dyes (a) and (b) exhibit a satisfactory heat resistance and dark decay.

The electrophotographic lithograph printing plate material is useful for providing a semiconductor laser ray-sensitive offset master plate, at a low cost, and contributes to the developing of the computerized technology for the plate-making and printing processes.

We claim:

1. An electrophotographic lithograph printing plate material comprising:

(A) an electroconductive and water-resistant support; and (B) an electrophotographic layer formed on a surface of the support and comprising at least finely divided photoconductive zinc oxide, a binder resin and a sensitizing dye material comprising:

(a) 30 to 99% by weight of a sensitizing dye consisting of at least one member selected from the group consisting of the compounds of the formulae (I), (II), and (V) to (VII):

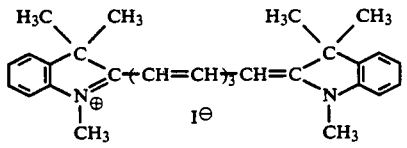

(I)

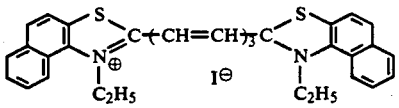

(II)

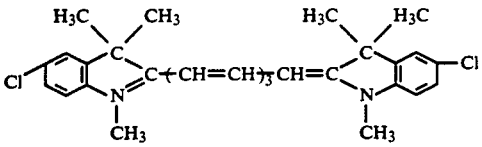

(V)

-continued

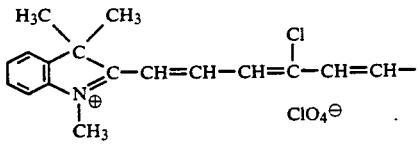

(VI)

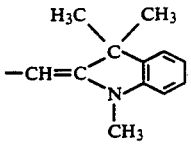

and

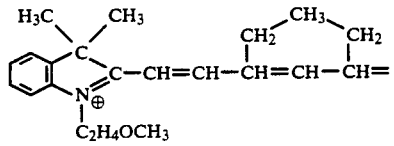

(VII)

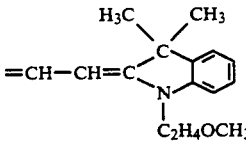

and capable of being adsorbed by the zinc oxide at an adsorption rate of less than 90%, and (b) 1 to 70% by weight of another sensitizing dye consisting of at least one member selected from the group consisting of the compounds of the formulae (III), (IV) and (VIII) to (X):

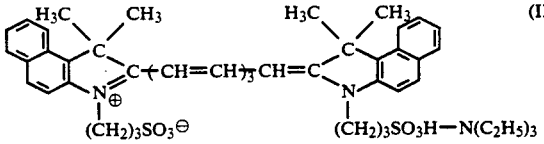

(III)

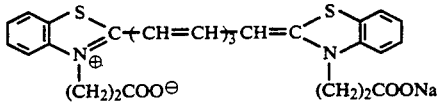

(IV)

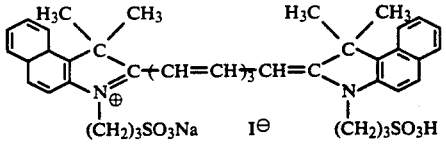

(VIII)

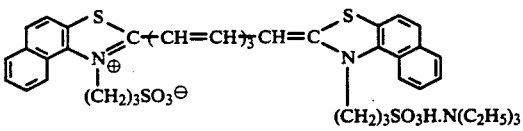

(IX)

and

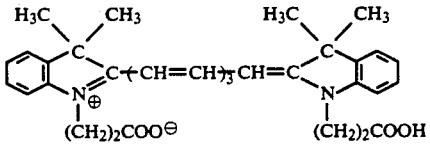

(X)

and capable of being adsorbed by the zinc oxide at an adsorption rate of 90% or more, said adsorption being determined in such a manner that a dye solution having a total weight of 50 g and a concentration of methyl alcohol of 15% by weight is prepared from a sensitizing dye in an absolute weight of 1 mg and a mixed solvent consisting of toluene and methyl alcohol, 2 g of finely divided zinc oxide are dispersed in the dye solution, the resultant dispersion is stirred and then left to stand at a temperature of 25° C. for one hour, to allow the resultant dye-adsorbed zinc oxide to be precipitated to provide a clear supernatant dye solution, a spectral absorption of the original dye solution and the resultant clear supernatant dye solution are measured at a wave length at which the dye exhibits a highest absorption, and the adsorption of the sensitizing dye by the finely divided zinc oxide is calculated in accordance with the equation:

$$\text{Adsorption rate (\%)} = \frac{A - B}{A} \times 100$$

wherein A represents a maximum spectral absorption of the original dye solution at the above-mentioned wave length and B represents a maximum spectral absorption of the supernatant dye solution at the same wave length as mentioned above.

2. The printing plate material as claimed in claim 1, wherein the low adsorption sensitizing dye (a) consists of the compound of the formula (I):

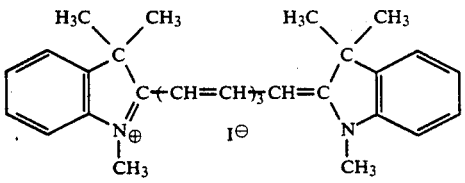

(I)

and the high adsorption sensitizing dye (b) consists of the compound of the formula (III):

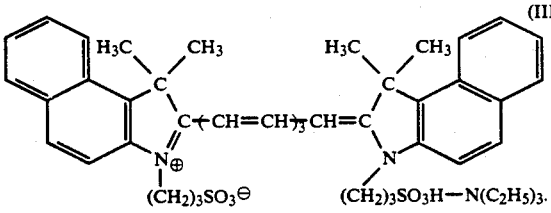

(III)

3. The printing plate material as claimed in claim 1, wherein the low adsorption sensitizing dye (a) consists of the compound of the formula (I):

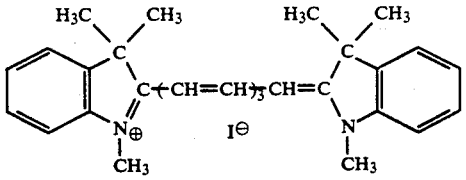

(I)

and the high adsorption sensitizing dye (b) consists of the compound of the formula (X):

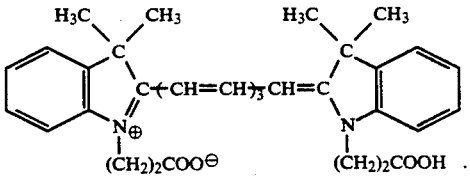

(X)

4. The printing plate material as claimed in claim 1, wherein the low adsorption sensitizing dye (a) is in an amount of 0.01 to 0.1% based on the total solid weight of the electrophotographic layer.

5. The printing plate material as claimed in claim 1, wherein the high adsorption sensitizing dye (b) is in an amount of 0.001 to 0.03% based on the total solid weight of the electrophotographic layer.

6. The printing plate material as claimed in claim 1, wherein the electrophotographic layer further contains a chemical sensitizing agent comprising at least one member selected from the group consisting of phthalic anhydride, maleic anhydride, dichloromaleic anhydride, pyromellitic anhydride, and trimellitic anhydride, in amount of 0.005 to 0.03% based on the total solid weight of the electrophotographic layer.

7. The printing plate material as claimed in claim 1, wherein the binder resin comprises an oil-soluble acrylic resin.

8. The printing plate material as claimed in claim 1, wherein the binder resin is in an amount of 10 to 30% based on the weight of the photoconductive zinc oxide.

9. The printing plate material as claimed in claim 1, wherein the support is composed of a member selected from electroconductive water resistant paper sheets, composite sheets each comprising a core paper sheet and at least one aluminum foil or electroconductive polymeric sheets laminated on the core paper sheet, and metallized paper sheets.

10. The printing plate material as claimed in claim 1, which further comprises an intermediate layer arranged between the support and the electrophotographic layer and comprising a water-resistant polymeric material.

* * * * *